US010080705B2

(12) United States Patent
Rees

(10) Patent No.: US 10,080,705 B2
(45) Date of Patent: Sep. 25, 2018

(54) TEAT FOR A BABY PRODUCT

(75) Inventor: Arnold Rees, Newcastle (GB)

(73) Assignee: Jackel International Limited, Cramlington, Northumberland (GB)

( * ) Notice: Subject to any disclaimer, the term of this patent is extended or adjusted under 35 U.S.C. 154(b) by 0 days.

(21) Appl. No.: 13/138,666

(22) PCT Filed: Mar. 22, 2010

(86) PCT No.: PCT/GB2010/000524
§ 371 (c)(1),
(2), (4) Date: Dec. 12, 2011

(87) PCT Pub. No.: WO2010/106346
PCT Pub. Date: Sep. 23, 2010

(65) Prior Publication Data

US 2012/0074090 A1 Mar. 29, 2012

(30) Foreign Application Priority Data

Mar. 20, 2009 (GB) ..... 0904863.8

(51) Int. Cl.
*A61J 11/00* (2006.01)

(52) U.S. Cl.
CPC ..... *A61J 11/0065* (2013.01); *A61J 11/005* (2013.01)

(58) Field of Classification Search
CPC ..... A47J 11/0065; A47J 11/005
USPC ..... 215/11.1–11.6
See application file for complete search history.

(56) References Cited

U.S. PATENT DOCUMENTS

| | | | | |
|---|---|---|---|---|
| 605,161 | A * | 6/1898 | Clement | 215/11.1 |
| 667,738 | A * | 2/1901 | Rosegrant | 215/11.1 |
| 1,683,246 | A * | 9/1928 | Griffiths | 215/11.1 |
| 1,821,913 | A * | 9/1931 | Smith | 215/11.1 |
| 1,902,433 | A * | 3/1933 | Brown | 215/11.1 |
| 6,957,744 | B2 * | 10/2005 | Holley, Jr. | 215/11.1 |
| 2004/0220618 | A1 * | 11/2004 | Rohrig | 606/234 |
| 2007/0068890 | A1 | 3/2007 | Rohrig | |
| 2007/0131637 | A1 | 6/2007 | Tamura et al. | |
| 2010/0268276 | A1 | 10/2010 | DuChesne et al. | |

FOREIGN PATENT DOCUMENTS

| | | |
|---|---|---|
| EP | 0151862 | 8/1985 |
| EP | 1652506 | 5/2006 |
| GB | 2402347 | 12/2004 |
| JP | 48-83285 | 10/1973 |
| JP | 55-47822 | 3/1980 |
| JP | 58-152934 | 10/1983 |
| JP | 63-032559 | 2/1988 |

(Continued)

OTHER PUBLICATIONS

International Search Report, dated Jun. 21, 2010.
Written Opinion of the International Searching Authority, dated Jun. 21, 2010.

*Primary Examiner* — Andrew T Kirsch
*Assistant Examiner* — Jennifer Castriotta
(74) *Attorney, Agent, or Firm* — Olson & Cepuritis, Ltd.

(57) ABSTRACT

A teat for a baby product comprises a flexible wall which is collapsible and has first and second protrusions disposed on an inner face thereof. When a force is applied to the wall, portions of the wall are brought proximal to one another and a protrusion is arranged to contact the inner face of the wall.

7 Claims, 9 Drawing Sheets

(56) References Cited

FOREIGN PATENT DOCUMENTS

| | | |
|---|---|---|
| JP | 1-207069 | 8/1989 |
| JP | 2004-191587 | 6/2004 |
| JP | 2006-006809 | 1/2006 |
| JP | 2007-508873 | 4/2007 |
| JP | 2007-181663 | 7/2007 |
| WO | 2008-154968 | 12/2008 |

* cited by examiner

TEAT FOR A BABY PRODUCT

The present invention relates to a teat and a baglet, in particular a teat for a baby product, such as a bottle, and a baglet for a soother.

If a teat were to collapse whilst feeding a baby, then milk flow from the teat may be significantly impeded or even cut off thereby frustrating the feeding baby. Teats having stiffening ribs or reinforcing projections on their inner wall ribs to resist the collapse of a teat due to pressure on the outside of the teat (e.g. from a baby's lips, gums or teeth, or reduced pressure within the bottle) are known. EP 0151862 B1, for example, discloses a teat having inclined inwardly directed stiffening ribs formed in a sidewall of a mouthpiece of the teat. Stiffening ribs are also disclosed in GB 2402347.

Strengthening against teat collapse is fine up to a point. However, the stiffening ribs are not able to completely prevent teat collapse under typical usage unless the teat or ribs are made with thick walls or rigid materials such as rigid grade of silicone. However, both of these options would provide a teat that is inflexible and alien to a feeding baby as such a teat would be very different to their mother's breast and nipple. This can lead to problems with rejection of rigid teats by a baby.

A key safety issue of flexible teats, e.g. made from a relatively soft grade silicon material, is that they must have a high bite-resistance so that even after prolong use and frequent biting by the baby, the teat is not damaged. If the teat were damaged, then the baby could bite off the tip of the teat which would constitute a dangerous choking hazard.

When a teat has a smooth wall, bite resistance of such a teat can be adequately high, even with soft grades of silicon, as the bite force from a baby on teat wall portions is evenly distributed over a relatively large surface area. However, when a baby bites a teat having inwardly projecting ribs, the ribs apply a force to a small localised region of the wall against which the ribs are pressed resulting in a large amount of localised pressure. This localised pressure significantly increases damage to the teat particularly at such regions and reduces the time taken for detrimental damage to occur. Such a problem is further exacerbated if ribs on opposing wall portions are pressed together when the teat is bitten. This would result in an even more highly localised high region of pressure at the point where ribs on opposing wall portions intersect one another.

Accordingly, in previous teats the presence of ribs means that bite resistance of the teat can fall short of safety standards unless teat walls are thickened or harder grades of material are used. However, such modifications then lead to the problem of a baby rejecting the resulting rigid teat.

Additionally, in previous teats, in some instances when a bite force is applied to the teat, opposing walls can contact one another and then move laterally relative to one another. Such rolling action is undesirable as it may disrupt the gums or newly erupted teeth of the feeding infant.

The invention is as set out in the claims.

Embodiments of the present invention seek to overcome or mitigate the above issues and problems. According to one embodiment, a flexible teat is provided. The walls of the teat are of a thickness and/or made of a material such that they are deformable and collapsible i.e. where generally opposing wall portions can be moved towards one another. In order to provide some measure of structural support and reinforcement, strengthening ribs are provided on inner wall portions of the teat. The teats and protrusions are designed so as not to preclude the possibility of the teat collapsing under relatively normal conditions which might arise when feeding, i.e. biting forces of a baby or internal/external pressure differentials induced during feeding. By providing a teat which allows for collapsing, whilst still allow enabling the passage of fluid therethrough, embodiments provide a teat that is not too flexible or rigid for a baby but, as will be described below, is sufficiently bite resistant so as to prevent any possible choking hazard. A first elongate protrusion is disposed on an inner surface of a first portion of the teat wall and second elongate protrusion disposed on an inner surface of a second portion of the teat wall which is generally opposite the first portion of the teat wall. The first elongate protrusion is arranged such that when a force is applied to one of the portions of the walls, such that the portions are brought towards one another, the first elongate protrusion is brought into contact with the inner face of the second portion of the walls. Likewise, the second elongate protrusion is arranged such that it contacts the inner surface of the first portion of the wall. The shape of the upper surface of the protrusions is designed such that it corresponds to and is complementary with the shape of the surface of the inner wall portion against which the protrusion contacts. This ensures a maximal surface area contact region between each protrusion and its respective inner wall portion. Such an arrangement, along with the addition of a number of elongate protrusions on the inner walls of the teat, enables biting force applied to the teat wall, e.g. from a baby biting the same, to be spread out amongst the number of elongate protrusions ensuring that there are no localised regions where the pressure levels are such that they reach a level that damages the teat. Furthermore, when an external force, such as a biting force, is applied to one of the portions of the wall such that the portions of the wall are brought proximal to one another thereby resulting in a collapsed state of the teat, the protrusions are arranged that such that they are spaced apart from one another and furthermore arranged such that they maintain separation between opposing inner surfaces of the teat wall. This inhibits complete collapse of the teat whereby the inner wall portions would otherwise contact each other and cut off passage of fluid through the teat. The arrangement of protrusions provides channels between the protrusions and the inner faces of the wall enabling the flow of fluid therethrough even when the teat has collapsed. Accordingly, not only do the protrusions provide structural support to the flexible teat aiding its resistance to biting and external forces, but also should the teat collapse the protrusions are arranged so as to distribute the force along the length and breadth of the protrusion and also spread the force amongst the protrusions, whilst still allowing passage of fluid through passages defined between the protrusions. Thus, an unimpeded feed can still take place even in the event that the teat is in a collapsed state. Further, the where first and second protrusions are on opposing inner walls of the teat then compressing the teats means that the protrusions lie adjacent to one another, effectively interlocking and restricting "rolling" of the teat as the protrusions cannot pass over one another.

In another embodiment, an oval teat is provided. With such a shaped teat, the teat is always orientated in one of only two orientations in a baby's mouth. This ensures that the baby always bites the teat in the same regions and the regions where external forces are applied can be predicted. The protrusions can then be arranged such that, when the teat is bitten, the protrusions do not press or touch against other protrusions, thereby avoiding the possibility of a protrusion intersecting another protrusion were the teat to collapse. Also, the protrusions can be arranged such that the biting pressure is dispersed amongst a number of protrusions at any one time. By utilising a number of protrusions, the biting force is spread over a larger area and the localised regions of an overly high pressure are prevented thereby reducing damage to the teat wall. Again, the protrusions are aligned so that compressing the teats means that the protrusions lie adjacent to one another, effectively interlocking and restricting "rolling" of the teat as the protrusions cannot pass over one another.

Other features and advantages of embodiments of the present invention will become apparent from the following detailed description. It should be understood, however, that the detailed description of specific embodiments is given by way of non-limiting sample only, with reference to the accompanying drawings, in which.

Figure 1:
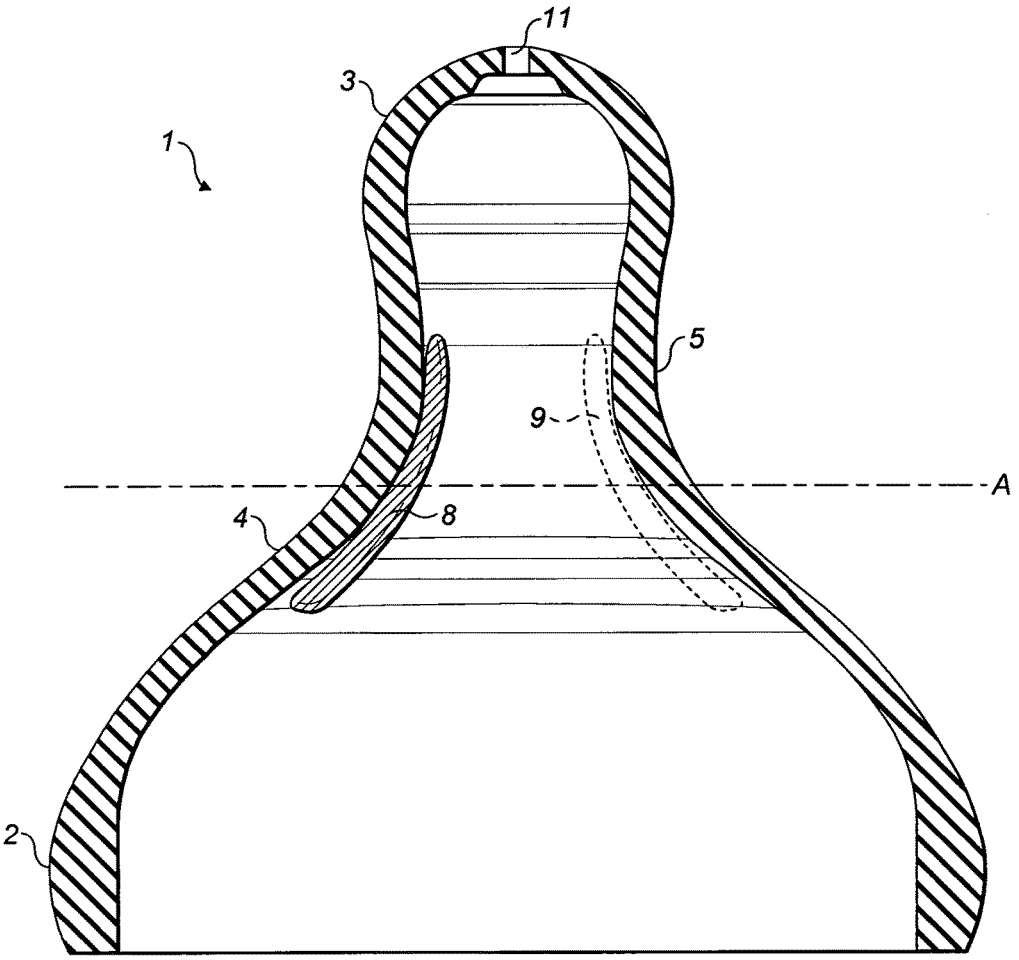
FIG. 1 shows a cross-sectional side view of a teat according to a first embodiment of the present invention.
Figure 3:
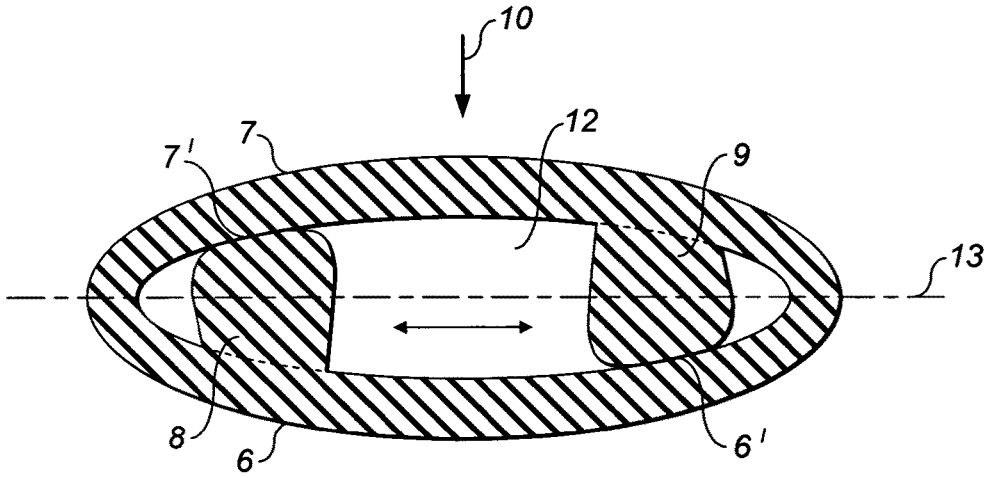
FIG. 3 shows a cross-sectional plan view of the teat of FIG. 1 in a collapsed state.

Referring to FIG. 1, a teat 1 according to a first embodiment of the present invention comprises a nipple section 3 connected to a wider intermediate section 4, such as an areola section, which itself extends to a base section 2. The base section can be secured to a bottle via a screw cap (not shown). The nipple section extends from the areola section. The wall 5 of the teat is made of a flexible material which enables the teat to be deformable so that it is able to collapse inwardly towards a central axis 13, as shown in FIG. 3, whereby a first portion of the wall 6 moves towards a generally opposing second portion of the wall 7. A first protrusion or strengthening rib 8 is disposed on an inner surface 6' of the first portion of the wall 6. Likewise, a second rib 9 is disposed on an inner surface 7' of the second portion of the wall 7.

Figure 2:
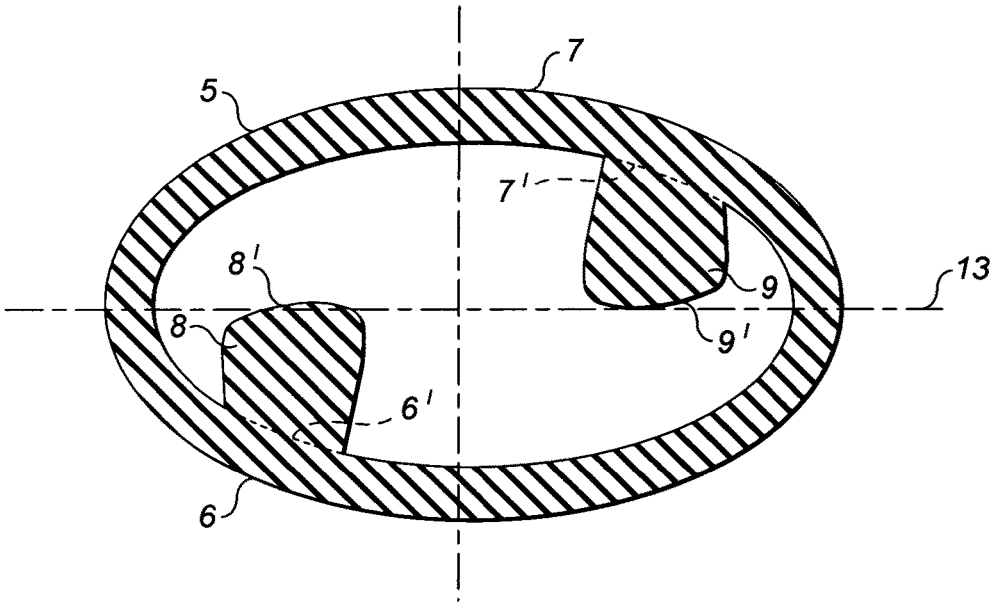
FIG. 2 shows a cross-sectional plan view of the teat of FIG. 1 in a normal state.

A biting region, which generally comprises the nipple section and/or the areola section, corresponds to a region of the teat where a baby's lips, gums or teeth are placed around the teat. This region is where a biting force 10 would be applied to one or both generally opposing portions of the teat wall. Where the force is sufficient, it causes the teat to collapse as shown in the cross-sectional plan view of FIG. 3 whereby the first 6 and second 7 portions of the wall are moved towards one another so that they become proximal. By contrast, FIG. 2 shows the same cross-sectional plan view of the teat (taken along the dashed line A of FIG. 1) in a normal non-collapsed state where the wall portions have not been moved towards one another. The first rib 8 is arranged on the inner face 6' of the first portion of the wall 6. The rib has a sufficient height so that the upper surface of the rib contacts the inner surface 7' of the second portion 7 of the wall. Likewise the second rib 9 is correspondingly arranged such that it contacts the inner surface 6' of the first portion 6 of the wall. The upper surface 8' and 9' of the protrusions 8 and 9 are preferably substantially flat and devoid of sharp edges so as to further increase the protrusion's contactable surface area thereby reducing pressure applied to the respective opposing portion of wall. Preferably, the upper surface of a rib 8', which contacts an opposing inner wall portion 7' of the teat when the teat is in a collapsed state, is shaped so as to be complementary to the shape of the surface of the opposing inner wall portion 7' against which the rib contacts so as to maximise the contact surface area between the rib and the inner wall portion. Furthermore, the ribs are mutually arranged on their respective portions of the wall such that they remain spaced apart from one another even in the collapsed state and do not touch one another. The ribs are elongate so as to offer an increased surface area contactable with their respective opposite wall inner surface. With such an arrangement, a biting force of a baby on the teat is spread evenly between and among the ribs thereby significantly reducing the damage cause to the wall.

The elongate protrusions are aligned in a direction towards an end 11 of the nipple section. By providing such an alignment, the ribs on opposing portions of the wall do not intersect or overlap one another which would cause localised regions of high pressure at points of intersection or overlap when the teat was in a compressed state. Such an issue is avoided with the alignment of the elongate ribs all towards the end point of the nipple section.

Preferably, the elongate ribs are structured so as to enable the distribution of any force therethrough substantially evenly along the rib's length. Similarly, the distribution of the protrusions around the inner surface of their respective portion of the wall is arranged such that any force transmitted through the ribs is evenly distributed among the ribs.

As has been previously described, when in a collapsed state, the first and second ribs of the teat are constructed so as to contact an opposing inner wall portion. This prevents opposing inner wall portions from touching one another and enables a channel 12 to be defined between the ribs, as shown in FIG. 3, which provides for the continual flow of the liquids therethrough even when the teat is in a collapsed state.

FIG. 2 corresponds to a cross-sectional view along the plane of the teat shown by the dotted line A in FIG. 1. It shows the teat cross-section in a normal, non-collapsed state. The flexible wall 5 has a cross-sectional shape of an oval. This provides the advantageous effect that the teat is always orientated in only of one or two directions when placed in a baby's mouth with the opposing elongate wall portions 6 and 7 being generally in transverse orientation during use. This ensures that the baby always bites the teat in approximately the same region and thus the region where the force is transmitted can be predicted and ribs can be suitably located. The ribs on the inner wall are arranged so that, when the teat is bitten and the teat collapses, the ribs do not press against other ribs and the biting force is applied to a number of ribs at any one time thereby reducing the pressure transmitted to the opposing inner wall portion.

The teat shown in FIGS. 1, 2 and 3 comprises only two ribs, however, in order to further increase the surface area over which a force is transferred by the ribs to an opposing wall portion preferably, a plurality of ribs are arranged on each the inner wall with previously mentioned restrictions on their arrangement and alignment. By utilising a number of ribs simultaneously, the biting force is spread over a larger area and the localised pressure does not exceed a level whereby damage is caused to the teat wall.

In the embodiment shown in FIGS. 4 to 7, two pairs of ribs 18 and 19 are provided, one member of each pair arranged on the first inner wall portion of the teat and the other member of the pair on the generally opposing second inner wall portion of the teat. The nipple and areola sections have an oval cross-sectional shape which is shown by which wider sections of front view of FIG. 5 in comparison to the sections in the side view of FIG. 4. The base 2 has a circular cross-sectional shape which enables it to fit in standard circular bottles (not shown). The oval cross-sectional shape of the areola and nipple portions, having a major axis 13 and minor axis 14, ensures that the teat is, in use, typically orientated in a baby's mouth with the minor axis in a vertical orientation and the major axis in a horizontal orientation. This serves to guarantee that any bite regions can be predicted (rather than biting being applied randomly around the surface, as would be the case in a teat whose nipple areola cross-sections were circular).

On the inside walls are provided two pairs of strengthening ribs 18 and 19. The pairs are located on opposing wall sections along the long sides 7 and 6 of the areola section of the teat, so that the first pair of ribs 18 is located on a first long inner wall section 6 and the second pair 19 is located on an opposing second long inner wall section 7. The pairs of ribs are arranged so that if the areola section is bitten and the long inner walls sections are forced together, then the first pair of strengthening ribs 18 will fit outside the second pair 19. In this arrangement, the biting force will be spread evenly among the four ribs, so that the damage caused by a biting force to the opposing inner wall sections is significantly reduced.

The arrangement of the strengthening ribs is such that even when the teat collapses (through biting or significantly reduced pressure within the feeding bottle) there are channels between the ribs and between the inner wall portions. These channels ensure that milk can still flow from the bottle to the teat and out of the opening in the tip of the teat 11 even when the teat is in a collapsed state.

Further, the ribs are aligned so that compressing the teats means that the ribs lie adjacent to one another, effectively interlocking and restricting "rolling" of the teat as the protrusions cannot pass over one another.

The teat can be attached to a feeding bottle in a standard manner such as a screw cap fitting (not shown) over a flange 16 of the base section 2 of the teat for securing the teat to a standard plastic or glass bottle by interacting the screw cap with a complimentary screw thread around the neck of the bottle. Additionally, the teat may be moulded with vents 15, e.g. slit valves or dome valves. Alternatively, the venting might be provided by channels in a screw cap (now shown).

Figure 4:
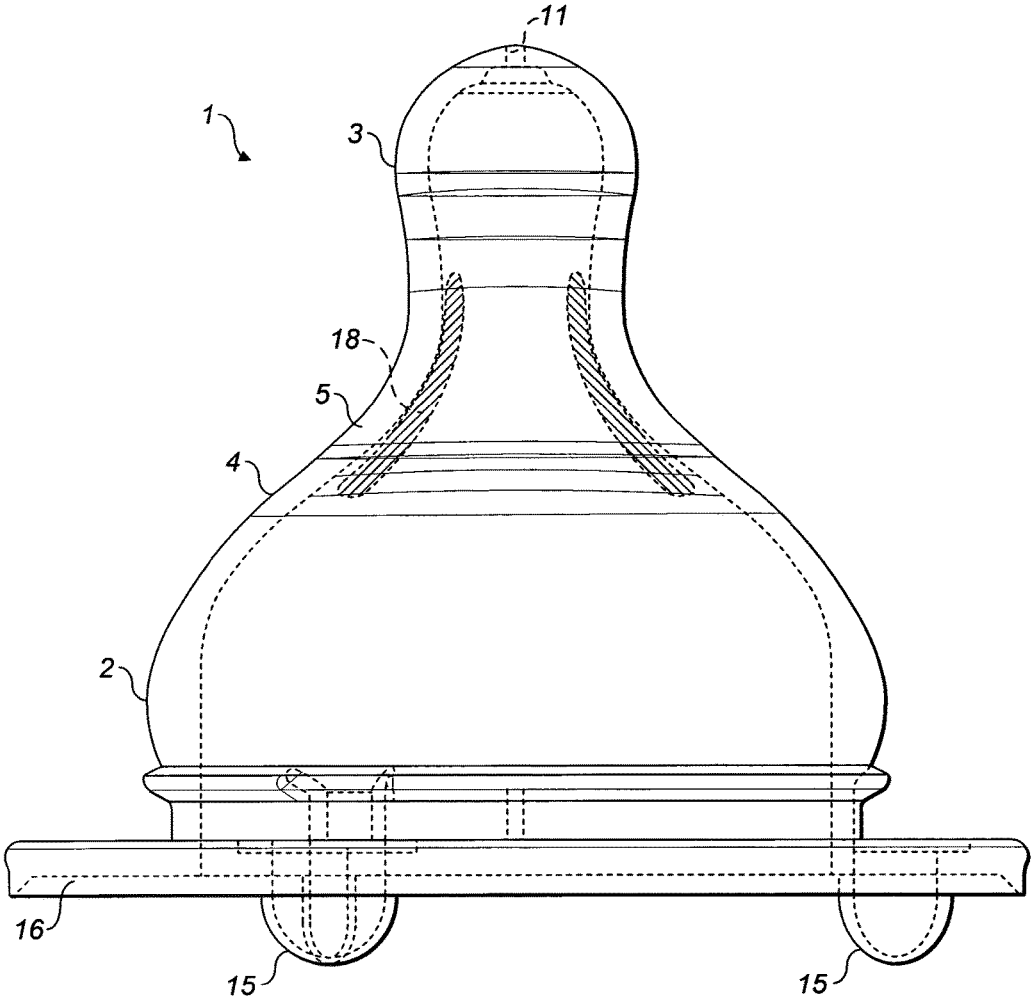
FIG. 4 shows a side view of a teat according to another embodiment of the present invention.
Figure 5:
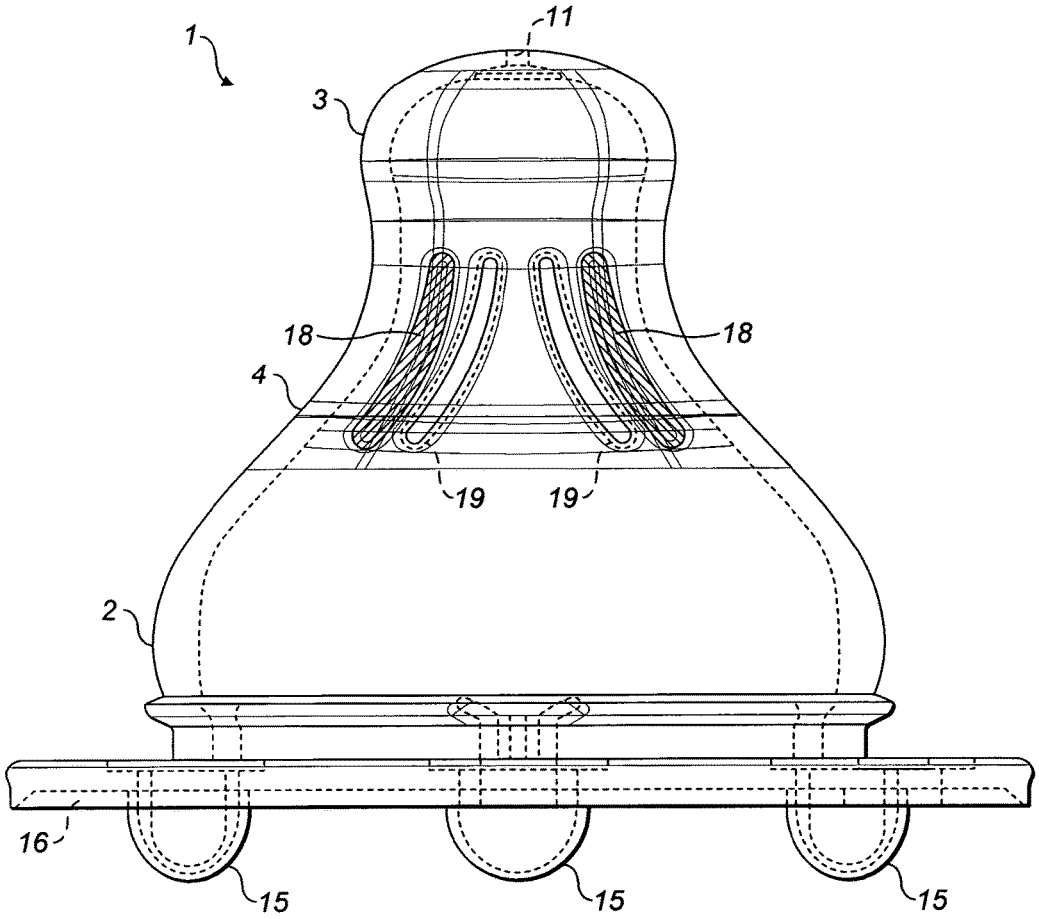
FIG. 5 shows a front view of the teat of FIG. 4.
Figure 6:
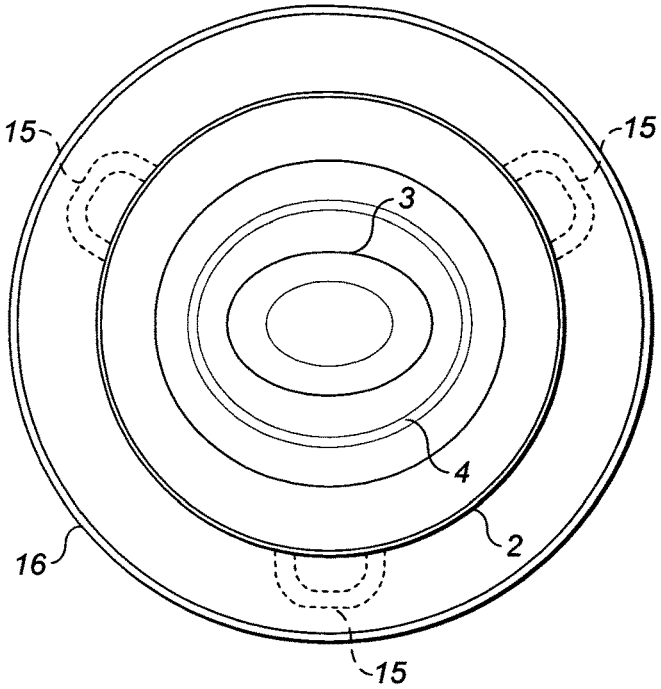
FIG. 6 show a plan view of the teat of FIG. 4.

FIG. 6 is a plan view of the embodiments of FIGS. 4 and 5. It shows the oval shape of the teat and nipple sections with a circular base section.

Figure 7:
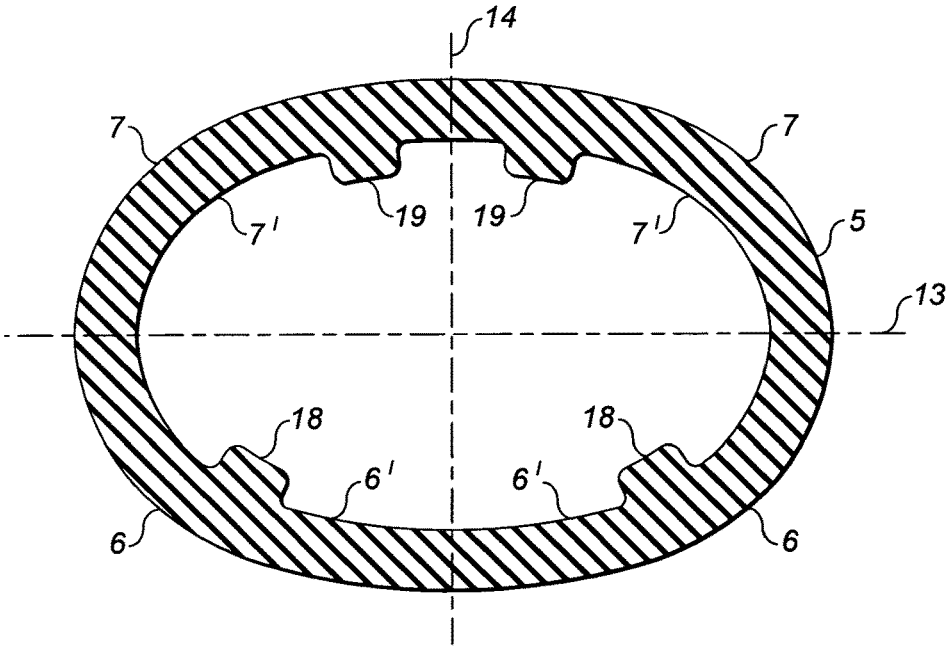
FIG. 7 is a cross-sectional plan view of the teat of FIG. 4.

FIG. 7 shows a cross-sectional view of a biting region of the teat which, in this embodiment corresponds to the areola section, though in other embodiments this region could be the nipple section or both sections. The pairs of ribs are integrally formed with the wall of the teat. They are arranged so that, if the areola section was bitten and the teat was to collapse, the ribs on one wall portion would fit inside the ribs of the generally opposing wall portion. Naturally, other arrangements of ribs would be evident to a person skilled in the art which would provide the desirous characteristics of the ribs supporting and keeping separate the inner wall portions of the teat in a collapsed state whilst also maintaining separation between the ribs themselves such that they do not touch one another in the collapsed state. As can be seen, the upper surface of each rib is generally flat such that the upper surface has a larger contactable surface area for abutting with its respective inner wall portion, than would otherwise be the case for a rib with an upper surface comprising a pointed edge.

Figure 8A:
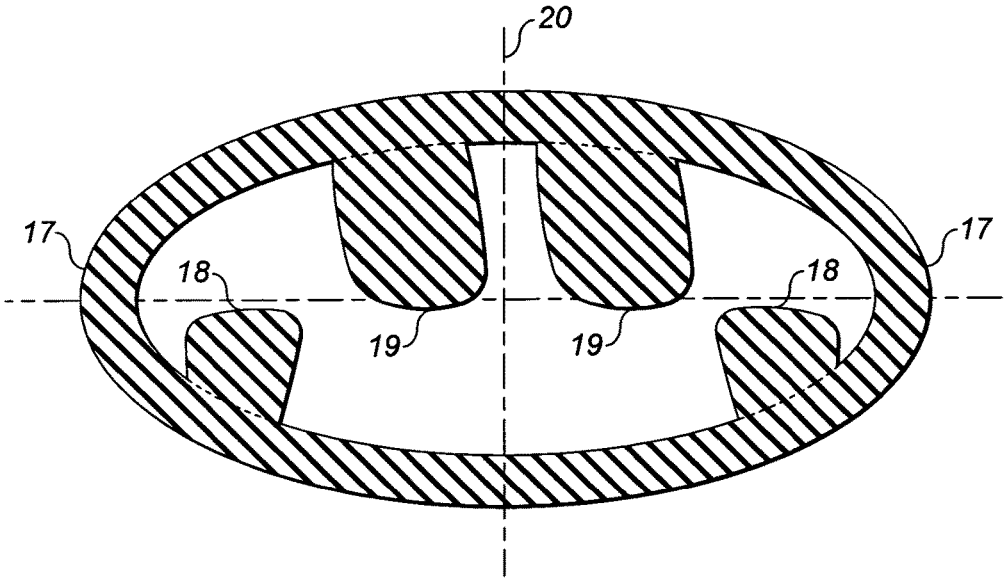
FIG. 8A is a cross-sectional plan view of a teat according to a further embodiment of the present invention in a normal state.
Figure 8B:
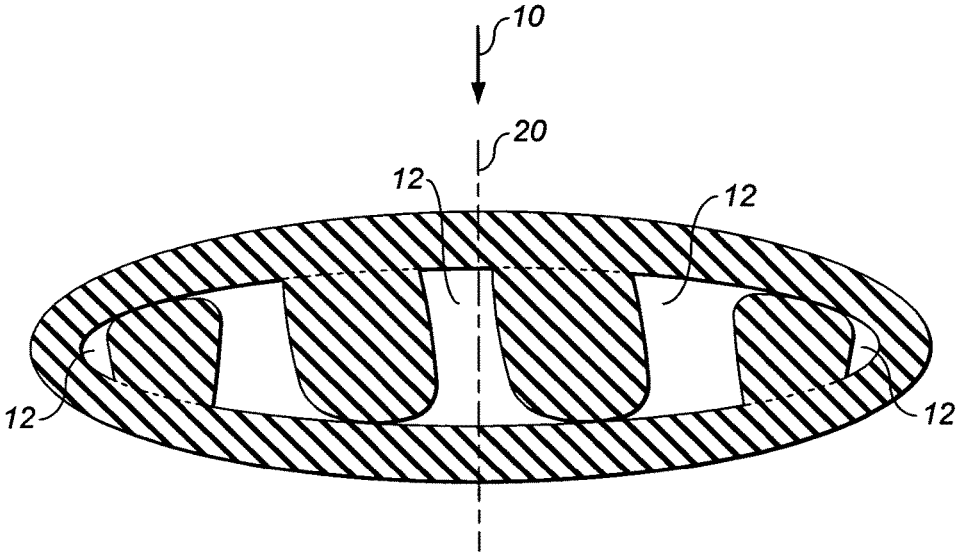
FIG. 8B is a cross-sectional plan view of the teat of FIG. 8A in a collapsed state.

FIGS. 8A and 8B show a further alternative arrangement of ribs whereby the height of one rib is different to the height of another rib. In particular, the ribs 18 which are located proximal to the narrow portions 17 of the wall have a height which is less than the ribs 19 located proximal to a central region 20 of the long portions 21 of the wall. It can be appreciated from FIG. 8B that, in the collapsed state, the opposing ribs almost effectively inter-engage or inter-mesh with one another, though importantly the ribs do not actually touch or abut one another.

Figure 9A:
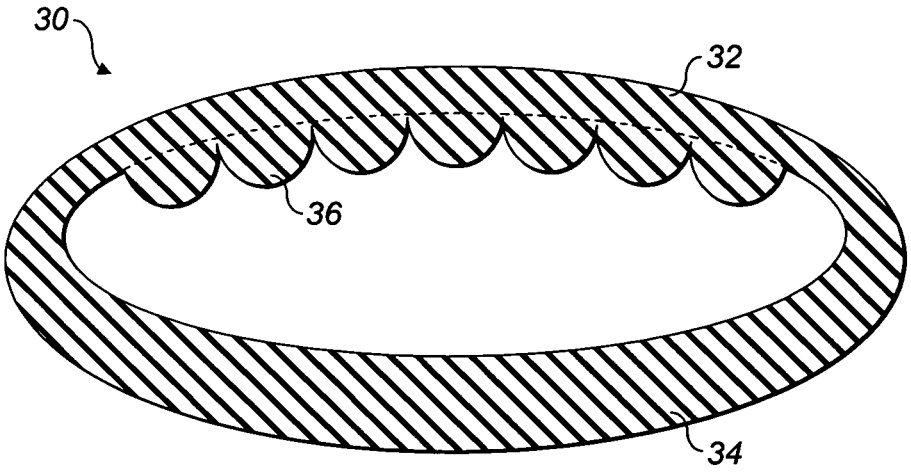
FIG. 9A shows a cross-sectional plan view of a teat according to another embodiment of the present invention.

FIG. 9A shows a further embodiment of the invention in which a teat designated generally 30 has an oval cross section and varying wall thickness such that one elongate wall of the teat 32 has a comparatively small thickness and the opposing elongate wall 34 has a comparatively large thickness. A plurality of strengthening ribs are provided extending inwardly from the inner surface of the thinner wall 32. In the embodiment shown the ribs are generally vertical in orientation (parallel to the teat axis) forming an array of touching ribs, the array extending all or most of the length of the elongate wall. The configuration provides additional strengthening of the wall 32 and additionally spreads the bite force between the ribs, reducing the individual point contact force if the teat is collapsed such that the ribs 36 touch the inner face of the opposing wall 34. In conjunction with the strengthening effect of the thicker wall 34, this provides an enhanced configuration.

Figure 9B:
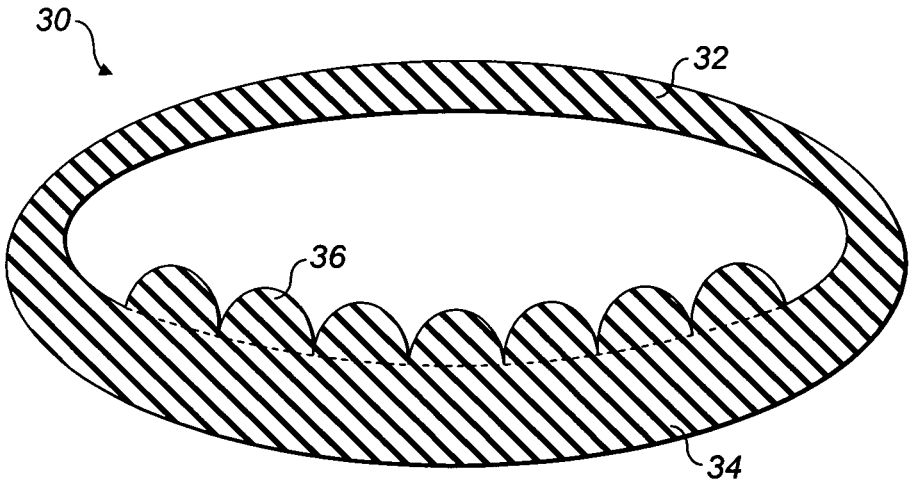
FIG. 9B shows a cross-sectional plan view of an alternative version of the teat of FIG. 9A.

In the alternative embodiment shown in FIG. 9B, a plurality of ribs 36 is provided in a similar manner to those of FIG. 9A, but on the inner surface of the thicker wall 34, with similar effects. In a further embodiment (not shown) the ribs can be provided from both opposing faces. When light pressure is applied the ribs will be forced towards one another and a rib on one side will tend to position itself between an adjacent pair of opposing ribs. In addition to providing the strengthening effect, this further prevents rolling of the teat, that is, lateral movement of the opposing walls and the teat is collapsed.

Figure 10A:
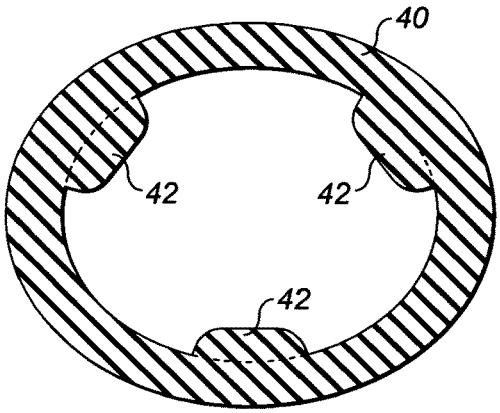
FIG. 10A shows a cross-sectional plan view of a teat according to another embodiment of the present invention.
Figure 10B:
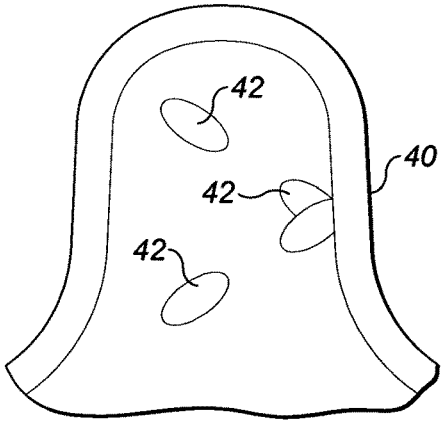
FIG. 10B shows a side view of a teat according to the embodiment of FIG. 10A.

Referring to FIGS. 10A and 10B, an alternative teat configuration is provided in which a teat having an outer wall 40 which can be oval, circular as shown or any appropriate shape. The teat has three angularly spaced ribs 42. The ribs are also staggered vertically as shown in FIG. 10B. As a result the ribs provide a strengthening effect but will not intersect with each other when the teat is collapsed because of their different heights. Although three ribs are shown it will be appreciated that any number of vertically staggered ribs can be provided. For example these can take the form of an interrupted helical rib passing down and around the inside of the teat.

Figure 11:
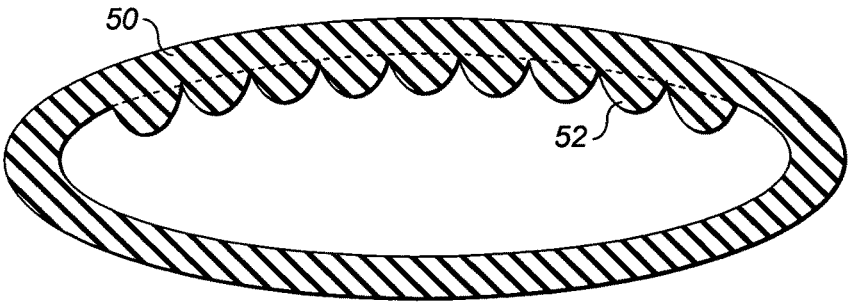
FIG. 11 shows a cross-sectional plan view of a teat according to another embodiment of the present invention.

Referring to yet a further embodiment, shown in FIG. 11, a teat having an outer wall 50 of consistent thickness has a plurality of ribs 52 provided along one inner face in a similar manner to the configuration of either FIG. 9A or FIG. 9B but once again with similar advantages available.

Figure 12A:
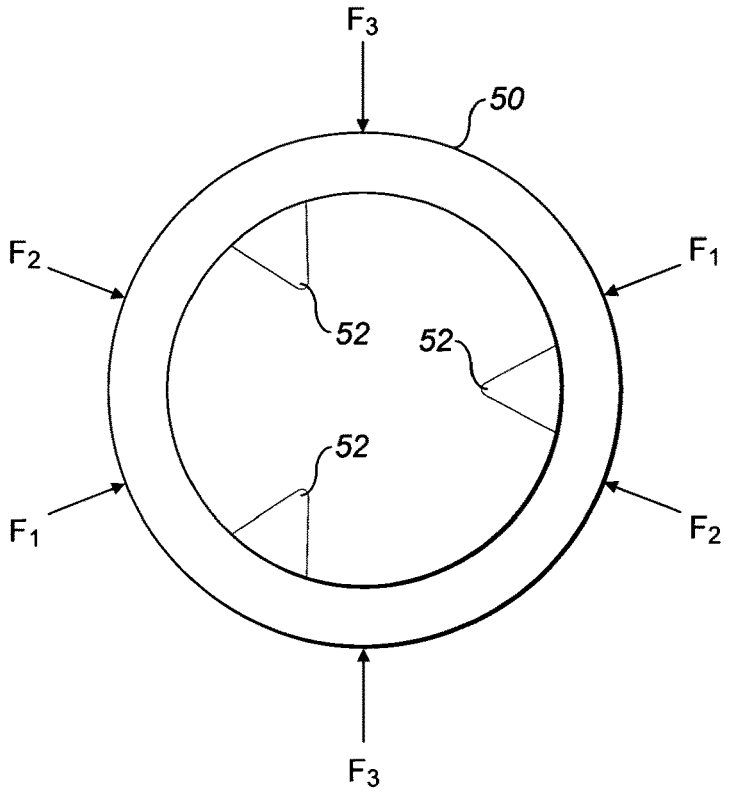
FIG. 12A shows a plan view of a teat according to another embodiment of the present invention.
Figure 12B:
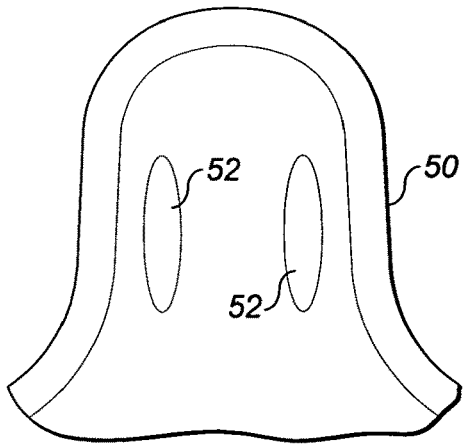
FIG. 12B shows a side view of a teat according to the embodiment of FIG. 12A.

Referring to the embodiments shown in FIGS. 12A and 12B a teat 50 having a circular cross-section includes three vertical ribs 52 equally angularly spaced around the inner wall of the teat 50. As a result of this configuration, no matter where the teat is compressed (for example pairs of compressive forces at points F1, F2 or F3) the ribs cannot be compressed on top of each other to intersect and create a point force.

The teat and ribs can be formed in any appropriate manner, for example compression or injection moulding and formed of any appropriate plastic material such as silicon, latex or thermoplastic elastomer (TPE). Injection moulded silicon provides a desirable degree of elasticity in the teat. The teat can have a texture such as a skin like texture mould or otherwise patterned on its surface. The ribs are preferably integrally formed with the teat. The teat can be of any appropriate shape which maybe, for example, cylindrical or non-symmetrical or closely mimicking the shape of the human breast.

It will be noted that other teat shapes include the circular or oval cross-sections as shown which can be applied as appropriate in each of the embodiments. It will further be noted that where appropriate any of the embodiments can have opposing thick and thin walls as discussed with reference to FIGS. 9A and 9B.

It will be appreciated that whilst embodiments have been described with regards to a teat, the above described arrangement of ribs on inner wall portions can also be used in baglets for infant soothers so as to achieve the same beneficial effect of increased bite resilience and reduced choking hazard.

Baglets comprise a nipple connected to an intermediate portion, such as a shaft, having a tubular section which has a diameter no larger than the nipple. The other end of the shaft extends to a base. A soother comprises such a baglet which is secured to a rigid shield to prevent swallowing and choking on the soother. The same arrangement of ribs as described above with respect to a teat nipple and/or areola portion can equally well be applied to a nipple and/or shaft portion of a baglet. Baglets are typically closed, so liquid does not have to flow through channels between the ribs. However, if the soother is of a type able to deliver liquid medication into an infant's mouth, then channels formed by ribs within an open baglet of the soother will work equally well to enable flow of liquid medication even in the event that the baglet collapses due to biting pressure or reduced pressure within the baglet.

The invention is not restricted to the features of the described embodiments. It will be readily apparent to those skilled in the art that is possible to embody the invention in specific forms other than those of the embodiments described above. The invention is defined by the following claims.

The invention claimed is:

1. A teat for a baby product having a base portion, a nipple portion with an end distal to the base portion and an areola portion disposed therebetween and extending from the nipple portion, the teat comprising:

the nipple portion having wall with a cross section that is generally oval and comprised of a first portion and a second portion, the generally oval cross section having a major axis that bisects the nipple such that the first portion of the wall is on one side of the major axis and the second portion of the wall is on the other side of the major axis;

the first portion of the wall having a first inner face that exhibits a curve and the second portion of the wall having a second inner face that exhibits a curve such that the cross section of the wall is generally oval;

a first protrusion disposed on the first inner face, the first protrusion having a having a length, width, and upper surface wherein the length is greater than the width; and a second protrusion disposed on the second inner face, the second protrusion having a having a length, width, and upper surface wherein the length is greater than the width;

wherein the first protrusion is disposed such that a straight line extending along the entirety of the length will not be parallel to the major axis;

wherein the second protrusion is disposed such that a straight line extending along the entirety of the length will not be parallel to the major axis;

wherein the upper surface of the first protrusion is not flat but instead curved such that it complements the curve of the second inner face disposed opposite to it; and wherein the upper surface of the second protrusion is not flat but instead curved such that it complements the curve of the first inner face disposed opposite to it.

2. the teat of claim 1 wherein the first protrusion further comprises a first protrusion wall having a height extending along the side of the first protrusion from the first inner face of the nipple portion to the upper surface of the first protrusion;

wherein the second protrusion further comprises a second protrusion wall having a height extending along the side of the second protrusion from the second inner face of the nipple portion to the upper surface of the second protrusion.

3. the teat of claim 2 wherein, when a force that is perpendicular to the major axis is applied to at least one of the first and second portions of the nipple, the first protrusion is configured to move toward the second inner surface and the second protrusion is configured to move toward the first inner surface, and wherein the first protrusion wall and the second protrusion wall are adapted to contact each other to prevent rolling where a subsequent force that is not perpendicular to the major axis is applied.

4. The teat of claim 1 wherein when a force that is perpendicular to the major axis is applied to at least one of the first and second portions of the wall such that the portions of the wall are brought proximal to one another, the second protrusion is arranged such that it only contacts the inner surface of the first portion of the wall.

5. The teat of claim 1 further comprising a plurality of protrusions on the first portion of the wall and a plurality of protrusions disposed on the second portion of the wall wherein when a force that is perpendicular to the major axis is applied to at least one of the first and second portions of the wall such that the portions of the wall are brought proximal to one another, the protrusions are arranged such that they only contact the opposing inner surface of the wall.

6. The teat of claim 1 wherein the first protrusion has a dimension that is different from a corresponding dimension of the second protrusion.

7. The teat of claim 1 having a first, comparatively thick wall segment and a second, comparatively thin wall segment, the wall segments generally opposing one another.

* * * * *